US008729441B2

(12) United States Patent
Kanzaki et al.

(10) Patent No.: US 8,729,441 B2
(45) Date of Patent: May 20, 2014

(54) HIGH-FREQUENCY HEATING APPARATUS

(75) Inventors: Kouji Kanzaki, Shiga (JP); Hisahiro Nishitani, Nara (JP)

(73) Assignee: Panasonic Corporation, Kadoma-Shi, Osaka (JP)

( * ) Notice: Subject to any disclaimer, the term of this patent is extended or adjusted under 35 U.S.C. 154(b) by 324 days.

(21) Appl. No.: 12/991,252

(22) PCT Filed: Apr. 28, 2009

(86) PCT No.: PCT/JP2009/001934

§ 371 (c)(1),
(2), (4) Date: Nov. 5, 2010

(87) PCT Pub. No.: WO2009/136484

PCT Pub. Date: Nov. 12, 2009

(65) Prior Publication Data

US 2011/0056933 A1 Mar. 10, 2011

(30) Foreign Application Priority Data

May 7, 2008 (JP) ..... 2008-121169

(51) Int. Cl.
*H05B 6/64* (2006.01)

(52) U.S. Cl.
USPC ..... 219/756; 219/681; 219/685

(58) Field of Classification Search
CPC ..... H05B 6/6485; F24C 1/04
USPC ..... 219/756, 680, 681, 685, 400, 702, 725, 219/741, 746, 749, 751, 754; 126/21 A, 126/19 R, 21 R, 299 D, 273 R; 99/476, 325
See application file for complete search history.

(56) References Cited

U.S. PATENT DOCUMENTS

| | | | | |
|---|---|---|---|---|
| 4,292,504 | A * | 9/1981 | Gebarowski et al. | 219/542 |
| 2002/0056712 | A1 | 5/2002 | Kim et al. | |
| 2003/0024925 | A1 * | 2/2003 | Graves et al. | 219/681 |

FOREIGN PATENT DOCUMENTS

| | | | |
|---|---|---|---|
| CN | 1159550 | C | 7/2004 |
| JP | 02-247420 | A | 10/1990 |
| JP | 05-090209 | U | 12/1993 |
| JP | 06-257761 | A | 9/1994 |
| JP | 07-119973 | A | 5/1995 |

(Continued)

OTHER PUBLICATIONS

International Search Report for International Application No. PCT/JP2009/001934, dated Aug. 11, 2009, 2 pages.

(Continued)

*Primary Examiner* — Quang Van
(74) *Attorney, Agent, or Firm* — Brinks Gilson & Lione

(57) ABSTRACT

There is provided a high-frequency heating apparatus including a heating chamber that houses an object to be heated, a rotating turntable provided on a bottom surface of the heating chamber, on which the object to be heated is rotatably mounted; a high-frequency heating section (21) that heats the object to be heated which is housed in the heating chamber, a convection heater (27) for heating the heating chamber, a circulating fan (28) for supplying the heating chamber with heat of the convection heater (27) as hot air, and a grill heater (33) for heating the object to be heated, wherein the convection heater (27) and the grill heater (33) are separately disposed on an upper surface of the heating chamber, thereby allowing reduction in size of an external shape of the heating apparatus without sacrificing grill cooking performance and oven cooking performance.

5 Claims, 4 Drawing Sheets

(56) References Cited

FOREIGN PATENT DOCUMENTS

| | | | |
|---|---|---|---|
| JP | 07-174344 | A | 7/1995 |
| JP | 2513829 | B2 | 7/1996 |
| JP | 2002-168460 | A | 6/2002 |
| JP | 2009-127900 | A | 6/2009 |
| KR | 10-0774503 | | 11/2007 |

OTHER PUBLICATIONS

Translation of Office Action in corresponding Russian Application No. 2010145104/03(065014), dated Oct. 8, 2013, 3 pages.

* cited by examiner

HIGH-FREQUENCY HEATING APPARATUS

TECHNICAL FIELD

The present invention relates to a high-frequency heating apparatus with a heater.

BACKGROUND ART

A conventional high-frequency heating apparatus of this kind has a grilling function of browning food with strong radiation heat and an oven function of increasing a food temperature by means of an atmospheric temperature. An apparatus that performs high-frequency heating and combines those two functions is the mainstream among commodity products generally termed microwave ovens (e.g. refer to Patent Literature 1).

FIG. 4 is one showing a lateral sectional view of a configuration of a conventional high-frequency heating apparatus with heaters (microwave oven). As shown in FIG. 4, in the conventional high-frequency heating apparatus, a high-frequency wave oscillated by magnetron 2 as a high-frequency oscillator in heating chamber 1 is guided by waveguide 3 to a heating chamber 1. Circulating fan 4 for supplying hot air is rotatably driven by motor 5, to supply hot air heated by convection heater 6 from air discharge holes 8, provided on heating-chamber rear wall 7, into the heating chamber.

Grill heater 9 is provided at a top of heating chamber 1, and radiation heat from grill heater 9 is radiated from punching holes 11, provided on heating-chamber upper wall 10, into heating chamber 1.

However, in the above conventional configuration, grill heater 9 is disposed on an upper surface of heating chamber 1 in order to brown a surface of food with radiation heat of grill heater 9 in grill cooking. Further, a convection unit that supplies hot air to heating chamber 1 is configured on a surface other than the upper surface of heating chamber 1 (rear surface of heating chamber 1 in this configuration). Therefore, the heating apparatuses have been disposed on the upper surface of heating chamber 1 and on the surface other than this upper surface, causing a problem of an increase in size of an exterior of the heating apparatus.

PATENT LITERATURE

PTL 1: Unexamined Japanese Patent Publication No. H07-119973

DISCLOSURE OF THE INVENTION

The present invention provides a high-frequency heating apparatus whose external shape can be reduced in size, while balancing efficient grill cooking and oven cooking in which an inside of a heating chamber is uniformly heated.

A high-frequency heating apparatus of the present invention includes a heating chamber that houses an object to be heated; a rotating turntable provided on a bottom surface of the heating chamber, on which the object to be heated is rotatably mounted; a high-frequency heating section that heats the object to be heated which is housed in the heating chamber; a first heater for heating the heating chamber; a circulating fan for supplying the heating chamber with heat of the first heater as hot air; and a second heater for heating the object to be heated, wherein the first heater and the second heater are separately disposed on an upper surface of the heating chamber.

With this configuration, the second heater that browns a surface of food and the first heater that supplies hot air to the heating chamber can be separately disposed on the upper surface of the heating chamber. Therefore, parts for heating can be intensively disposed and parts to be disposed on a side surface and a rear surface of the heating chamber can be eliminated without sacrificing grill cooking performance and oven cooking performance. Accordingly, an external shape of the heating apparatus can be reduced in size.

DETAILED DESCRIPTION OF THE PREFERRED EMBODIMENTS

Hereinafter, an embodiment of the present invention is described with reference to the drawings. It is to be noted that the present invention is not limited by this embodiment.

Figure 1:
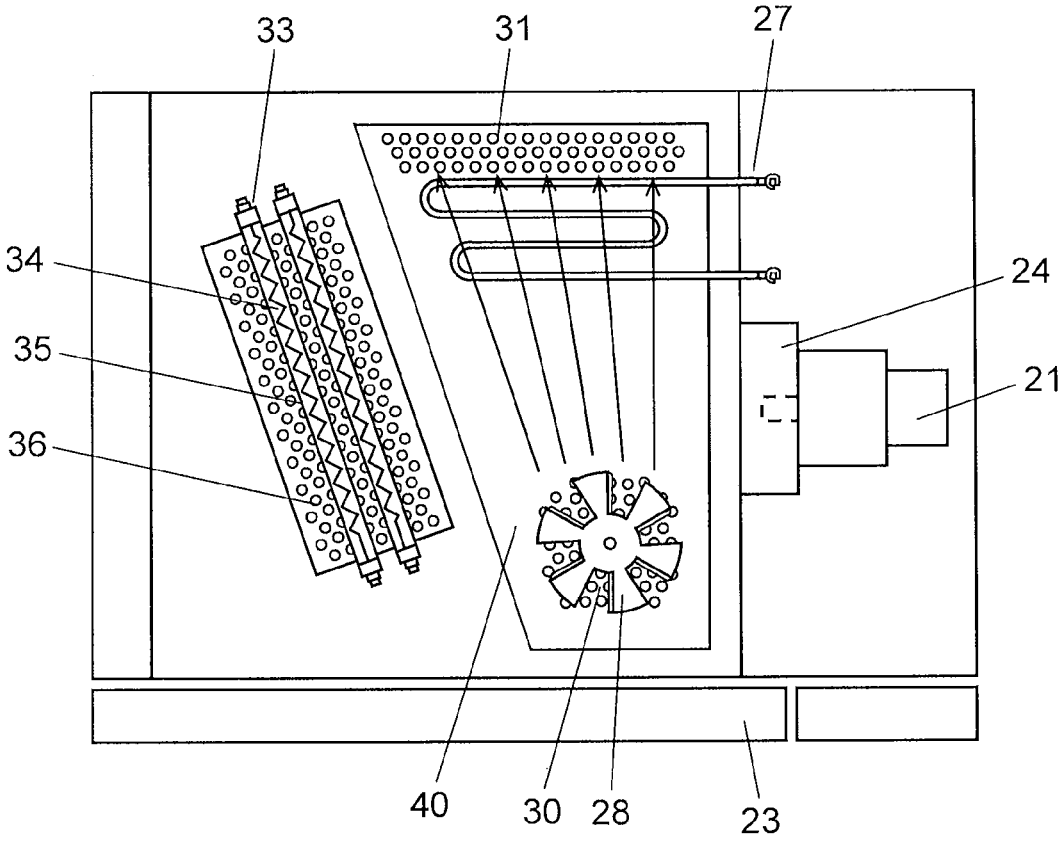
FIG. 1 is a top view of a high-frequency heating apparatus in an embodiment of the present invention.
Figure 2:
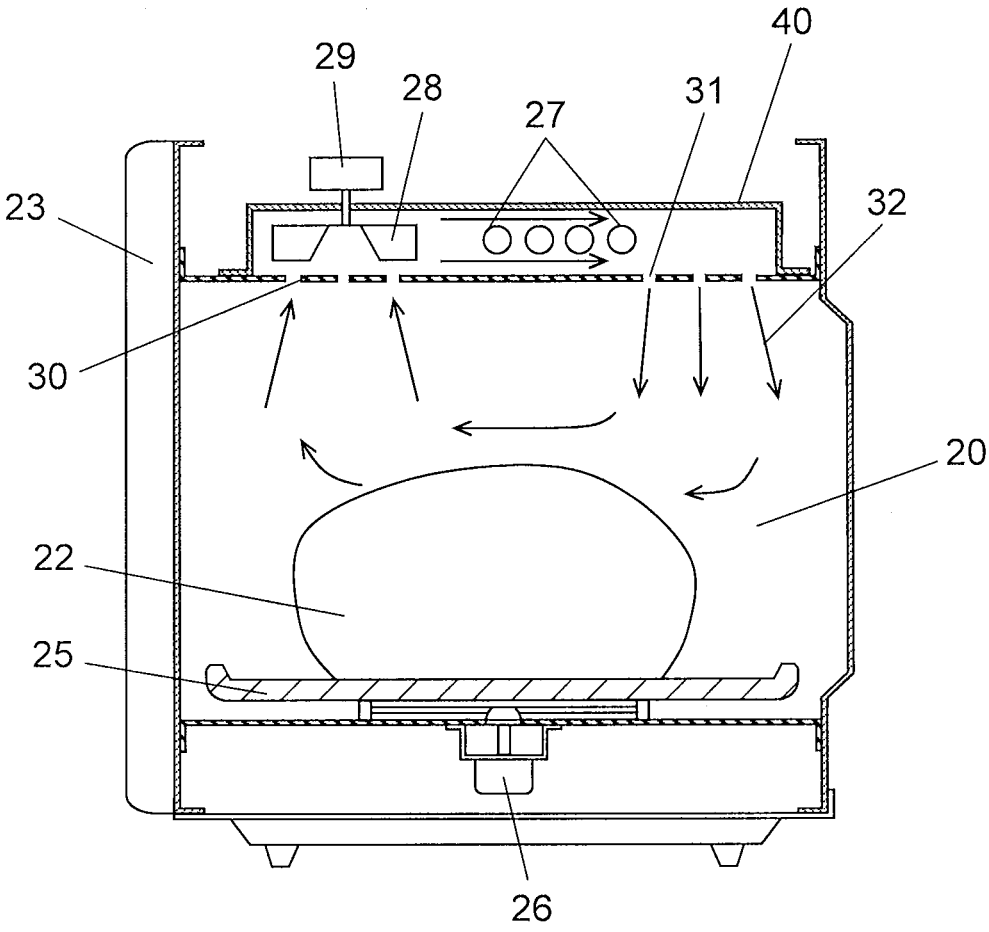
FIG. 2 is a lateral sectional view of the high-frequency heating apparatus in the embodiment.
Figure 3:
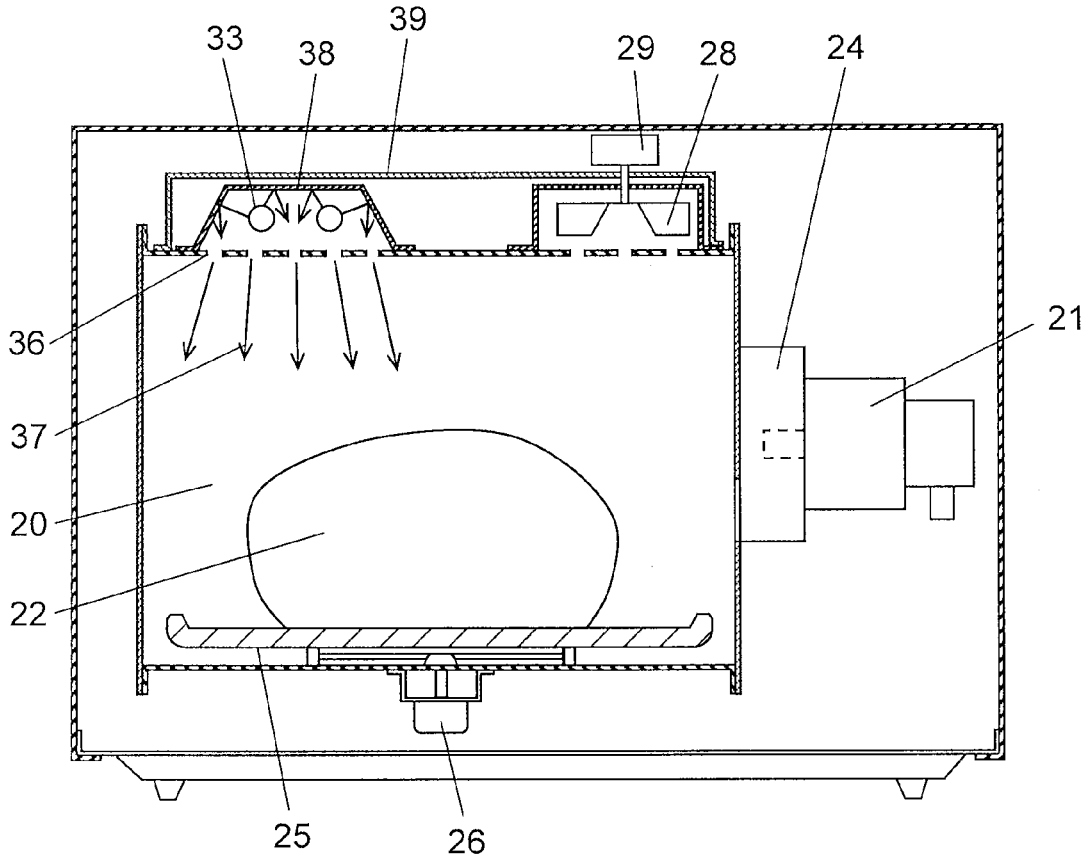
FIG. 3 is a frontal sectional view of the high-frequency heating apparatus in the embodiment.
Figure 4:
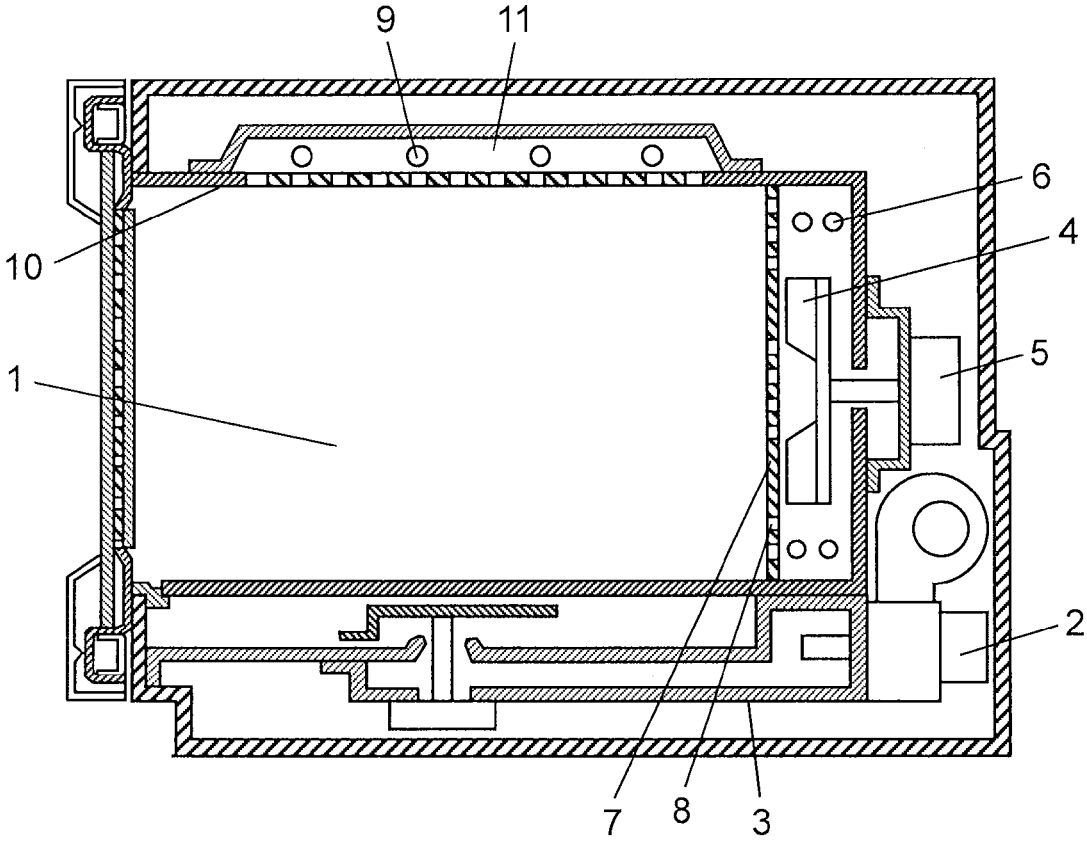
FIG. 4 Prior Art
FIG. 4 is a sectional view of a conventional high-frequency heating apparatus.

FIGS. 1 to 3 respectively show a top view, a lateral sectional view, and a frontal sectional view of a high-frequency heating apparatus in the embodiment according to the present invention.

In each of the figures, object 22 to be heated is housed in heating chamber 20. A high-frequency wave generated by high-frequency heating section 21 is guided by waveguide 24 to heating chamber 20. On a front surface of heating chamber 20, openable and closable door 23 is provided. On a bottom surface of heating chamber 20, rotating turntable 25 is provided on which object 22 to be heated is mounted. Rotating turntable 25 is rotatably driven by motor 26 to rotatably move object 22 to be heated, so as to prevent concentration of heating on a local part.

On an upper surface of heating chamber 20, first heater (hereinafter referred to as convection heater) 27 that heats heating chamber 20 is fixed in circulating fan case 40. Circulating fan 28 is rotatably driven by circulating fan motor 29. With rotation of circulating fan 28, air inside heating chamber 20 is inhaled from air intake holes 30 that are provided on the upper surface of heating chamber 20, and the air is heated by convection heater 27 and then supplied from air discharge holes 31 into heating chamber 20.

Air intake holes 30 are disposed at a right-side front of heating chamber 20, and air discharge holes 31 are disposed at right-side rear thereof. Therefore, as shown with arrows of FIGS. 1 and 2, a well-ordered circulating channel is configured in which hot air 32 blown out of air discharge holes 31 passes above and below object 22 to be heated, and is inhaled into air intake holes 30. Forming such a configuration can lead to reduction in size of a configuration of a convection unit made up of circulating fan 28, convection heater 27, circulating fan case 40, air intake holes 30, and air discharge holes 31. In this manner, convection heater 27 supplies hot air 32 for convection inside heating chamber 20.

Second heater (hereinafter referred to as grill heater) 33 is installed on a left side of the upper surface of heating chamber 1, at an angle inclined from the front to the rear. A heating member for grill heater 33 is coil-shaped nichrome heating wire 34, which is housed inside transparent glass tube 35 provided with both insulation and protection. Below grill heater 33, radiation holes 36 are provided which discharge radiation heat 37 to heating chamber 20 as shown with arrows of FIG. 3.

Further, reflector 38 is provided around an area above grill heater 33, and from heat rays cut off by reflector 38, far-infrared rays are supplied as secondary radiation to the heating chamber. As in grill heater 33, radiation holes 36 are provided on the left side of the upper surface of the heating chamber, at an angle inclined from the front to the rear, and radiation heat is supplied diagonally from a side of object 22 to be heated.

As thus described, in the present embodiment, grill heater 33 is configured such that nichrome heating wire 34 is inserted into quartz glass tube 35 and the area above radiation holes 36 is covered by reflector 38.

Therewith, since the object to be heated is rotatably driven by rotating turntable 25, radiation heat is supplied from a periphery of the object to be heated to uniformly brown the object, while heating is prevented from concentrating on a central part of rotating turntable 25 that makes a smaller move. Further, a start-up of heating in grill cooking becomes faster, thus allowing improvement in heating efficiency through use of heat rays reflected by reflector 38 above radiation holes 36.

Insulating board 39 covers over convection heater 27 and grill heater 33, thereby to shut off hot air from these two heaters. This prevents leakage of hot air from a heating section made up of convection heater 27 and grill heater 33, to improve heating efficiency and prevent an increase in temperature of external parts so as to enhance reliability. In the present embodiment, with all the heaters configured on the upper surface of the heating chamber in such a manner as described above, it is possible to reduce the insulating board in size, thereby making efficiently heat insulation.

As described above, the high-frequency heating apparatus according to the present invention includes a heating chamber that houses an object to be heated, a rotating turntable provided on a bottom surface of the heating chamber, on which the object to be heated is rotatably mounted, a high-frequency heating section that heats the object to be heated which is housed in the heating chamber, a first heater for heating the heating chamber, a circulating fan for supplying the heating chamber with heat of the first heater as hot air, and a second heater for heating the object to be heated, wherein the first heater and the second heater are separately disposed on an upper surface of the heating chamber.

It is thereby possible to eliminate parts to be disposed on the side surface and the rear surface of the heating chamber without sacrificing grill cooking performance and oven cooking performance, thus leading to reduction in size of the external shape of the heating apparatus. Further, with the heating parts disposed to be concentrated, a cooling structure is not dispersedly disposed, and it is thereby possible to efficiently perform heat insulation and cooling, further contributing to cost reduction.

Moreover, the high-frequency heating apparatus according to the present invention has a configuration where a circulating fan case, housing the circulating fan and the first heater, and a convection unit, made up of air intake holes and air discharge holes for circulating hot air in the heating chamber, are provided, radiation holes that radiate heat to the object to be heated are provided with respect to the second heater, and the air intake holes, the air discharge holes and the radiation holes are disposed at positions out of a center of the heating chamber.

Therefore, the apparatus is formed with a structure where grilling performance (heating of the object to be heated) and convection performance (hot air convection function) are made separately independent, and the air intake holes, the air discharge holes and the radiation holes are disposed at positions out of the center of the heating chamber. It is thereby possible to prevent concentration of heating on the central part of the rotating turntable, so as to improve cooking performance.

Furthermore, the high-frequency heating apparatus according to the present invention has a configuration where the second heater is formed by inserting a nichrome heating wire into a quartz glass tube, and an area above the heater is covered by a reflector above the radiation holes.

It is thereby possible to make a start-up of heating in grill cooking faster, so as to improve heating efficiency through use of heat rays that are reflected by the reflector above the radiation holes.

INDUSTRIAL APPLICABILITY

The present invention allows reduction in size of an external shape of a heating apparatus without sacrificing grill cooking performance and oven cooking performance, and is thus applicable to a high-frequency heating apparatus with a heater, and the like.

REFERENCE MARKS IN THE DRAWINGS

20 heating chamber
21 high-frequency heating section
22 object to be heated
23 door
24 waveguide
25 rotating turntable
26 motor
27 convection heater
28 circulating fan
29 circulating fan motor
30 air intake hole
31 air discharge hole
32 hot air
33 grill heater
34 nichrome heating wire
35 glass tube
36 radiation hole
37 radiation heat
38 reflector
39 insulating board
40 circulating fan case

What is claimed is:

1. A high-frequency heating apparatus, comprising:

a heating chamber that houses an object to be heated;

a rotating turntable provided on a bottom surface of the heating chamber, on which the object to be heated is rotatably mounted;

a high-frequency heating section that heats the object to be heated which is housed in the heating chamber;

a case positioned above a section of an upper surface of the heating chamber, the case including a top surface and side surfaces wherein the section of the upper surface of the heating chamber defines at least one air intake hole and at least one air discharge hole for circulating hot air in the heating chamber, wherein the top surface, side surfaces, and the section of the upper surface of the heating chamber together define an enclosed space whereby air enters the enclosed space via the at least one air intake hole and exits the enclosed space via the at least one air discharge hole;

a first heater disposed within the case;

a fan disposed within the case that draws air into the case via the at least one air intake hole and discharges substantially all the air drawn into the case via the at least one air discharge hole, wherein the air in the case is heated by the first heater; and a second heater for heating the object to be heated disposed above the section of the upper surface of the heating chamber and outside of the enclosed space.

2. The high-frequency heating apparatus according to claim 1, comprising:

at least one radiation hole defined on the upper surface of the heating chamber and below the second heater that radiates heat to the object, wherein the air intake hole, the air discharge hole and the radiation hole are disposed at positions offset from a center of the heating chamber.

3. The high-frequency heating apparatus according to claim 1, wherein the second heater is configured by inserting a nichrome heating wire into a quartz glass tube, and an area above the heater is covered by a reflector above the radiation holes.

4. The high-frequency heating apparatus according to claim 1, wherein the second heater is installed at an angle inclined from the front to the rear.

5. The high-frequency heating apparatus according to claim 1, wherein the width of air discharge holes area is wider than the width of air intake holes area.

* * * * *